US006756741B2

(12) United States Patent
Li

(10) Patent No.: US 6,756,741 B2
(45) Date of Patent: Jun. 29, 2004

(54) DRIVING CIRCUIT FOR UNIT PIXEL OF ORGANIC LIGHT EMITTING DISPLAYS

(75) Inventor: Chun-Huai Li, Hsien (TW)

(73) Assignee: Au Optronics Corp., Hsinchu (TW)

( * ) Notice: Subject to any disclaimer, the term of this patent is extended or adjusted under 35 U.S.C. 154(b) by 0 days.

(21) Appl. No.: 10/396,780

(22) Filed: Mar. 26, 2003

(65) Prior Publication Data

US 2004/0007989 A1 Jan. 15, 2004

(30) Foreign Application Priority Data

Jul. 12, 2002 (TW) ..... 91115606

(51) Int. Cl.[7] ..... G09G 3/10

(52) U.S. Cl. ..... 315/169.3; 315/169.1; 345/92; 345/204

(58) Field of Search ..... 315/169.1–169.3; 345/92, 204, 36, 45, 46, 76, 82, 214

(56) References Cited

U.S. PATENT DOCUMENTS 6,356,029 B1 * 3/2002 Hunter ..... 315/169.1
6,373,454 B1 * 4/2002 Knapp et al. ..... 345/76
6,618,030 B2 * 9/2003 Kane et al. ..... 345/82
6,670,773 B2 * 12/2003 Nakamura et al. ..... 315/169.3
6,680,580 B1 * 1/2004 Sung ..... 315/169.3

* cited by examiner

*Primary Examiner*—Don Wong
*Assistant Examiner*—Trinh Vo Dinh
(74) *Attorney, Agent, or Firm*—Troxell Law Office PLLC

(57) ABSTRACT

A driving circuit for an organic light emitting diode comprises the following elements. A driving transistor has a control terminal, a first electrode and a second electrode, wherein the first electrode and the second electrode are connected to a power line and the organic light emitting diode. A first switch device can be turned on by a scan signal to electrically conduct the power line and the control terminal of the driving transistor for maintaining the control terminal at the voltage level of the scan signal. And a second switch device can be turned on by the scan signal to electrically conduct a data line and the second electrode of the driving transistor for transferring the data signal to the second electrode and maintaining the second electrode at the voltage level of the data signal. Thus, by maintaining the control terminal of the driving transistor and the second electrode at the certain levels the operation current of the driving transistor will not affected by the voltage difference between two electrodes of the organic light emitting diode.

12 Claims, 1 Drawing Sheet

DRIVING CIRCUIT FOR UNIT PIXEL OF ORGANIC LIGHT EMITTING DISPLAYS

FIELD OF THE INVENTION

The present invention relates to a driving circuit for organic light emitting displays (OLEDs), and more specifically, to a driving circuit applied to drive organic light emitting diodes and amorphous silicon thin film transistors (a-Si TFT) in a unit pixel to prolong lifetime of the OLEDs.

BACKGROUND OF THE INVENTION

With the advance of techniques for manufacturing integrated circuits, the development and progress of electronic science cause various electronic products fabricated with digital and complicated designs. And for the conveniences of portability and utility, these electronic products are designed with smaller appearances, multiple functions and rapid processing rates. Thus, the products of new generation are easy to carry and fit modern life. Especially because the powerful processing ability of multimedia products can handle easily the audio, visual and graphical digital data, the visual displays are widely researched and developed. No matter what kind of electronics, such as PDAs, laptops, walkmans, digital cameras or mobile phones, all need the display panels for viewing and browsing.

In conventional manufacturing processes of displays, because the techniques of thin film transistors are mature, the liquid crystal displays with the advantages of lightweight, lower consumption and non-irradiation are favored and widely used by consumers. However, with the research and development of organic light emitting diodes, the new generation of organic light emitting displays have further advantages of high light-emitting efficiency, high responding rate, power saving, no limitation of viewing angle, lightweight, thinness, brightness and all colors. And by applying the OLEDs the portable electronic products are manufactured with smaller sizes and finest graphic displaying effects.

Please refer to FIG. 1, a circuit 10 of unit pixel for OLEDs in the prior art is illustrated. The circuit 10 is defined on an amorphous silicon substrate and has two thin film transistors 12, 14 and a storage capacitor 16 so as to drive an organic light emitting diode 18. The transistor 12 is briefly served as a switch device of which a drain electrode is connected to a data line, a gate electrode is connected to a scan line and a source electrode is connected to both one terminal of the storage capacitor 16 and the gate electrode. On the other hand, a drain electrode of the transistor 14 is connected to a power line (Vdd). And a source electrode of the transistor 14 and another terminal of the storage capacitor 16 are both connected to a positive terminal of the organic light emitting diode 18. With regard to a negative terminal of the organic light emitting diode 18 is connected to a power line (Vss).

Thus, the signal from the scan line can turn the transistor 12 on to transfer image data of the data line to the unit pixel. When the transistor 12 is turned on, the data signal on the data line can transfer to the gate of the transistor 14 and be stored in the capacitor 16. This data signal can also turn the transistor 14 on to transfer the voltage signal of the power line (Vdd) to the positive terminal of the organic light emitting diode 18 for luminescence. The data voltage stored in the capacitor 16 can be applied to keep the transistor 14 turned on while the signal on the scan line turns the transistor 12 off so as to maintain the organic light emitting diode 18 at a certain current level.

However, it is noted that in the above circuit design, the voltage difference $V_{OLED}$ between two terminals of the organic light emitting diode 18 will affect the gate-to-source voltage (Vgs) and the drain current (Id) of the transistor 14 due to the organic light emitting diode 18 is connected directly to the source electrode of the transistor 14. The current formula is shown as follows:

$$Id = \frac{1}{2} * K(Vgs - Vth)^2$$
$$= \frac{1}{2} * K[Vdata - (V_{OLED} - V_{SS}) - Vth]^2,$$

In above formula, K is a constant, Vdata is the voltage signal on the data line, and Vth is the threshold voltage of the transistor 14. After a long time of operation, the voltage difference $V_{OLED}$ between two terminals of the organic light emitting diode 18 will increase so as to reduce the drain current (Id), to decrease the lightness of the organic light emitting diode and to shorten the lifetime of the displays.

SUMMARY OF THE INVENTION

A purpose of the present invention is to provide a unit pixel circuit for OLEDs to prevent the voltage difference between two terminals of the organic light emitting diode from varying and to avoid of reducing the operating current of the driving transistor.

Another purpose of the present invention is to provide a circuit design to prevent from reducing the brightness of the OLEDs and to prolong the lifetime of the displays.

The present invention discloses a driving circuit of an organic light emitting diode. The driving circuit comprises the components as follows. A driving transistor has a gate, a source and a drain, wherein the drain is connected to a power line and the source is connected to the organic light emitting diode. A first switch transistor has a first gate, a first drain and a first source, wherein the first gate is connected to a scan line, the first source is connected to the power line, and the first drain is connected to the gate of the driving transistor. When the first switch transistor is turned on by the scan signal on the scan line, the voltage signal on the power line will turn the driving transistor on. A second switch transistor has a second gate, a second drain and a second source, wherein the second gate is connected to the scan line, the second drain is connected to a data line and the second source is connected to the source of the driving transistor. When the scan signal on the scan line turn the second switch transistor on, the data signal on the data line can transfer to the source of the driving transistor.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention provides a unit pixel circuit structure for active matrix organic light emitting diodes (OLEDs)

with amorphous silicon TFTs and organic light emitting diodes. Two switch transistors are provided to turn a driving transistor on or off and to maintain the gate-to-source voltage at a certain level. Thus, the voltage difference $V_{OLED}$ between two electrodes of the organic light emitting diode will not affect the operating current of the driving transistor. And after a long time of operation, even though the voltage difference $V_{OLED}$ increases, the operating current of the driving transistor can be maintained at a certain level. So the brightness of the organic light emitting diode will not decrease and the lifetime of the displays can be prolonged effectively. The detailed description is as follows.

Figure 1:
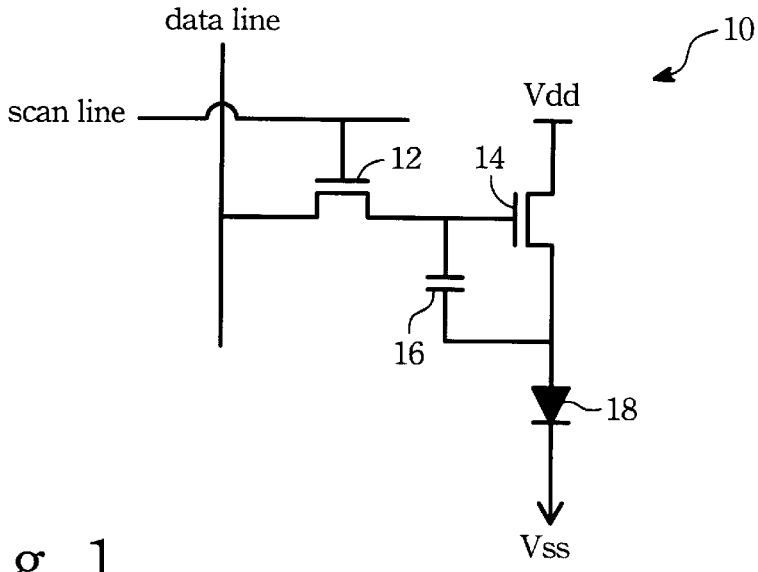
Fig. 1 (Prior Art)
FIG. 1 illustrate the unit pixel circuit structure of the OLEDs according to the prior art.
Figure 2:
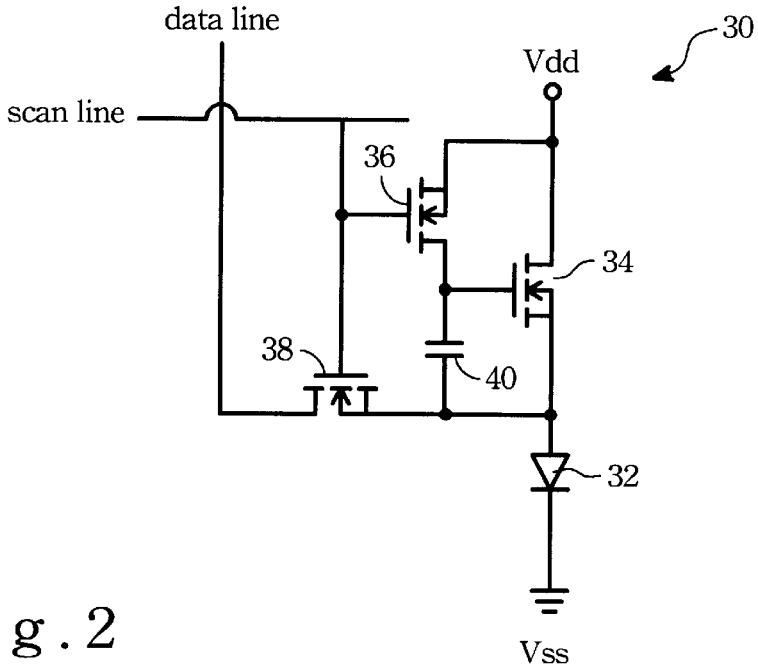
FIG. 2 illustrate the unit pixel circuit structure of the OLEDs according to the present invention.

Please refer to FIG. 2, an unit pixel circuit 30 for OLEDS provided by the present invention is illustrated. As well know in the prior art, thin film transistors and interconnections are defined on a glass substrate firstly. These interconnections comprises scan lines and data lines which are arranged in a crisscross pattern to connect each unit pixel for sending scan signals and data signals. And each unit pixel 30 comprises an organic light emitting diode 32, a driving transistor 34 and two switch transistors 36 and 38.

The organic light emitting diode 32 has a positive terminal and a negative terminal, wherein the negative terminal is connected to a ground line Vss, and the positive terminal is connected through a driving transistor 34 to a power line Vdd. The driving transistor 34 has three electrodes of a gate, a drain and a source, wherein the gate is served as a control terminal. The gate of the driving transistor 34 is connected to the scan line. So the scan signals of the scan line can be applied to turn the driving transistor 34 on or off. And the drain and source of the driving transistor 34 are connected respectively to the power line Vdd and the positive terminal of the organic light emitting diode 32 to transfer the voltage signal of the power line Vdd to the organic light emitting diode 32 for luminescence.

Notedly, in the present invention, for the purpose of preventing the voltage difference between two terminals of the organic light emitting diode from affecting the drain current of the driving transistor 34 two transistors are introduced to turn the driving transistor 34 on or off and to maintain the gate-to-source voltage at a certain level. A gate of the switch transistor 36 is connected to the scan line, and a source thereof is connected to the power line Vdd, and a drain thereof is connected to the gate of the driving transistor 34. When the switch transistor 36 is turned on by the scan signal on the scan line, the voltage signal on the power line Vdd will be transferred to the gate of driving transistor 34 for turning it on. In the mean, while, the voltage level of the gate of the driving transistor 34 is maintained at the level of the scan signal.

As to another switch transistor 38 of which a gate is connected to the scan line, a drain is connected to the data line, and a source is connected to the drain of the driving transistor 34. When the switch transistor 38 is turned on by the scan signal, the data signal of the data line can be transferred to the source of the driving transistor 34 to maintain it at the voltage level of the data signal.

It is noted that the unit pixel circuit in the present invention also has a storage capacitor 40. One terminal of the storage capacitor 40 is connected to both the gate of the driving transistor 34 and the source of the switch transistor 36. As to another terminal of the storage capacitor 40 is connected to both the source of the driving transistor 34 and the source of the switch transistor 38. Therefore, when the switch transistor 36 is turned on, the storage capacitor 40 is charged. And after that, when the switch transistor 36 is turned off, the storage capacitor 40 can applied to maintain the gate of the driving transistor 34 at a certain voltage level. Thus, in the time interval of turning the switch transistor 36 on and off, the current of the organic light emitting diode can be kept at a certain current level.

The voltage level of the gate of the driving transistor 34 is equal to that of the power line Vdd by introducing the switch transistor 36 in the present invention. And by applying the switch transistor 38, the voltage level of the source of the driving transistor 34 is equal to that of the data signal. So the gate-to-source voltage (Vgs) can be kept at a certain level, and the drain current (Id) thereof will not be affected by the voltage difference $V_{OLED}$. The current formula is as follows:

$$Id = \frac{1}{2} * K(Vgs - Vth)^2$$
$$= \frac{1}{2} * K[(Vdd - Vdata) - Vth]^2$$

In above formulas, K is a constant, Vdata is voltage signal on the data line, and Vth is the threshold voltage of the driving transistor 34. Apparently, from the formulas, after a long time of operation the drain current (Id) of driving transistor 34 will not be affected even though the voltage difference $V_{OLED}$ increases.

The unit pixel circuit of the OLEDs provided by the present invention has some advantages as follows:

(1) Because the drain current of the driving transistor is unconcerned with the voltage difference between two terminals of the organic light emitting diode, the operating current of the driving transistor will not decrease with voltage varying of the organic light emitting diodes while the display is operated a long time.

(2) Because the drain current is kept at a certain value, the brightness of the organic light emitting diodes will not decrease. Thus, the image quality of the displays can be promoted and the lifetime thereof can be prolonged effectively.

While the preferred embodiment of the invention has been illustrated and described, it will be appreciated that various changes can be made therein without departing from the spirit and scope of the invention. For example, in above embodiments, NMOS transistors are applied to serve as the switch devices, wherein a first switch device is used for turning the driving transistor on or off and maintaining the gate thereof at a certain voltage level, and a second switch device is used for controlling the source of the driving transistor at a certain voltage level. To those people skilled in the art, it is easy to be understood some other electronic devices can be chosen to replace the NMOS transistors for the identical functions.

What is claimed:

1. A driving circuit for an organic light emitting diode, said driving circuit comprises:

a driving transistor having a control terminal, a first electrode and a second electrode, wherein said first electrode and said second electrode are connected respectively to a power line and an organic light emitting diode;

a first switch device responsive to a scan signal from a scan line to electrically conduct said power line and said control terminal of said driving transistor to maintain said control terminal at a certain voltage level equal to that of said power line; and a second switch device responsive to said scan signal from said scan line to electrically conduct a data line and said second electrode of said driving transistor and to transfer a data signal of said data line to said second electrode for maintaining said second electrode at a certain voltage level equal to that of said data signal;

wherein said control terminal and said second electrode are maintained respectively at certain voltage levels to prevent an operating current of said driving transistor from affection of a voltage difference between two terminals of said organic light emitting diode.

2. The driving circuit of claim 1, wherein said first switch device is a transistor of which a gate is connected to a scan line, a source and a drain are connected respectively to said power line and said control terminal of said driving transistor.

3. The driving circuit of claim 1, wherein said second switch device is a transistor of which a gate is connected to a scan line, a drain and a source are connected respectively to said data line and said second electrode of said driving transistor.

4. The driving circuit of claim 1, wherein said control terminal of said driving transistor is a gate, said first electrode is a drain and said second electrode is a source.

5. The driving circuit of claim 1, further comprises a storage capacitor of which two terminals are respectively connected to said gate and said source of said driving transistor.

6. A driving circuit for an organic light emitting diode, said driving circuit comprises:

a driving transistor having a gate, a source and a drain, wherein said drain is connected to a power line and said source is connected to said organic light emitting diode;

a first switch transistor has a first gate, a first drain and a first source, wherein said first gate is connected to a scan line, said first source is connected to said power line and said first drain is connected to said gate of said driving transistor, when said first switch transistor is turned on by said scan signal from said scan line, a voltage signal of said power line can turn said driving transistor on; and a second switch transistor has a second gate, a second drain and a second source, wherein said second gate is connected to said scan line, said second drain is connected to a data line, and said second source is connected to said source of said driving transistor, when said second switch transistor is turned on by said scan signal from said scan line, a data signal of said data line is applied to said drain of said driving transistor.

7. The driving circuit of claim 6, further comprises a storage capacitor of which two terminals are respectively connected to said first drain of said first switch transistor and said second source of said second switch transistor.

8. An unit pixel circuit for an organic light emitting display comprises:

a scan line for transferring a scan signal to said unit pixel circuit;

a data line for transferring a data signal to said unit pixel circuit;

an organic light emitting diode has a positive terminal and a negative terminal, wherein said negative terminal is connected to a ground terminal;

a driving transistor has a control terminal, a first electrode and a second electrode, wherein said first electrode and said second electrode are respectively connected to a power line and said positive terminal of said organic light emitting diode;

a first switch transistor responsive to said scan signal of said scan line to electrically conduct said power line and said control terminal of said driving transistor for maintaining said control terminal at the voltage level of said scan signal; and a second switch transistor responsive to said scan signal of said scan line to electrically conduct said data line and said second electrode of said driving transistor for maintaining said second electrode at the voltage level of said data signal;

when said first switch transistor and said second switch transistor are turned on by said scan signal, said first electrode and said second electrode of said driving transistor are conducted to transfer said data signal of said data line to said source of said driving transistor.

9. The circuit of claim 8, wherein a gate of said first switch transistor is connected to said scan line, and a source and a drain thereof are respectively connected to said power line and said control terminal of said driving transistor.

10. The circuit of claim 8, wherein a gate of said second switch transistor is connected to said scan line, a drain and a source thereof are connected respectively to said data line and said second electrode of said driving transistor.

11. The circuit of claim 8, wherein said control terminal of said driving transistor is a gate, said first electrode is a drain and said second electrode is a source.

12. The circuit of claim 8, further comprises a storage capacitor of which two terminals are connected respectively to said gate and said source of said driving transistor.

* * * * *